US011022012B2

(12) United States Patent
Butterworth et al.

(10) Patent No.: US 11,022,012 B2
(45) Date of Patent: Jun. 1, 2021

(54) FLUID METHOD AND SYSTEM

(71) Applicant: Castrol Limited, Reading (GB)

(72) Inventors: Donald Butterworth, Wayne, NJ (US); Daniel Cadigan, Wayne, NJ (US); William Rosanio, Wayne, NJ (US)

(73) Assignee: Castrol Limited, Reading (GB)

( * ) Notice: Subject to any disclaimer, the term of this patent is extended or adjusted under 35 U.S.C. 154(b) by 0 days.

(21) Appl. No.: 15/762,478

(22) PCT Filed: Sep. 23, 2016

(86) PCT No.: PCT/US2016/053371
§ 371 (c)(1),
(2) Date: Mar. 22, 2018

(87) PCT Pub. No.: WO2017/053750
PCT Pub. Date: Mar. 30, 2017

(65) Prior Publication Data

US 2018/0266288 A1 Sep. 20, 2018

(30) Foreign Application Priority Data

Sep. 23, 2015 (GB) ..... 1516864.4

(51) Int. Cl.
*F01M 11/04* (2006.01)

(52) U.S. Cl.
CPC . *F01M 11/0458* (2013.01); *F01M 2011/0483* (2013.01)

(58) Field of Classification Search
CPC ..... F01M 11/0458; F01M 2011/0466; F01M 2011/0483; F01M 13/0011; F01M 2013/0044
See application file for complete search history.

(56) References Cited

U.S. PATENT DOCUMENTS 4,075,099 A * 2/1978 Pelton ..... B01D 35/027 123/196 A
4,151,823 A * 5/1979 Grosse ..... F01M 11/03 123/196 A (Continued)

FOREIGN PATENT DOCUMENTS

DE 102012024365 6/2016
WO WO-0153663 A2 * 7/2001 ..... F01M 11/04

(Continued)

*Primary Examiner* — Ryan A Reis
(74) *Attorney, Agent, or Firm* — McDonnell Boehnen Hulbert & Berghoff LLP

(57) ABSTRACT

A method of filling and/or draining a replaceable fluid container for an engine or vehicle, wherein the replaceable fluid container comprises a fluid reservoir and a plurality of container ports, wherein replaceable fluid container is configured to be docked with a dock associated with the vehicle or engine with the plurality of container ports positioned on and coupled to at least one port of the dock to place the fluid reservoir in fluidic communication with a fluid circulation system associated with the vehicle or engine, wherein each of the plurality of container ports has an operational function, wherein the operational function of at least one of the plurality container ports is that of being a fluid outlet port to allow the supply of fluid from the fluid reservoir, the method comprising modifying the operational function of at least one of the plurality of container ports to assist filling and/or draining of the reservoir, a related filling and/or draining interface plate configured to interface between a replaceable fluid container for a vehicle or engine and a filling and/or draining system of a replaceable fluid container management facility and a kit comprising such an interface plate and a replaceable fluid container for a vehicle or engine.

25 Claims, 8 Drawing Sheets

(56) References Cited

U.S. PATENT DOCUMENTS

| | | | | |
|---|---|---|---|---|
| 4,491,103 | A | 1/1985 | Deadman | |
| 5,454,354 | A | 10/1995 | Miller | |
| 5,640,936 | A * | 6/1997 | Hudson | F01M 1/12 123/196 A |
| 6,170,505 | B1 | 1/2001 | Erwin | |
| 8,613,297 | B2 | 12/2013 | Adams et al. | |
| 9,089,799 | B2 | 7/2015 | Crary | |
| 9,869,219 | B2 | 1/2018 | Barnes et al. | |
| 9,878,822 | B2 | 1/2018 | Barnes et al. | |
| 9,890,901 | B2 | 2/2018 | Brett et al. | |
| 10,167,755 | B2 | 1/2019 | Andersen et al. | |
| 10,358,259 | B2 | 7/2019 | Andersen et al. | |
| 10,449,933 | B2 | 10/2019 | Barnes et al. | |
| 10,473,006 | B2 | 11/2019 | Ali et al. | |
| 10,502,104 | B2 | 12/2019 | Dawson et al. | |
| 10,533,469 | B2 | 1/2020 | Goodier et al. | |
| 2003/0015463 | A1 * | 1/2003 | Viken | F01M 11/0458 210/138 |
| 2009/0283363 | A1 | 11/2009 | Lockwood et al. | |
| 2011/0253092 | A1 | 10/2011 | Springer et al. | |
| 2013/0048088 | A1 | 2/2013 | Miller | |
| 2015/0291317 | A1 | 10/2015 | Brett et al. | |
| 2015/0292372 | A1 | 10/2015 | Barnes et al. | |
| 2017/0089235 | A1 | 3/2017 | Dawson et al. | |
| 2017/0101911 | A1 | 4/2017 | Barnes et al. | |
| 2017/0183992 | A1 | 6/2017 | Barnes et al. | |
| 2018/0080353 | A1 | 3/2018 | Cadigan et al. | |
| 2018/0087418 | A1 | 3/2018 | Cadigan et al. | |
| 2018/0258806 | A1 | 9/2018 | Butterworth et al. | |

FOREIGN PATENT DOCUMENTS

| | | | |
|---|---|---|---|
| WO | WO 2003/106598 | 12/2003 | |
| WO | WO 2013/055375 | 4/2013 | |
| WO | WO 2014/076316 | 5/2014 | |
| WO | WO 2014/076318 | 5/2014 | |
| WO | WO 2014/076319 | 5/2014 | |
| WO | WO-2014076314 A2 * | 5/2014 | F01M 11/04 |
| WO | WO 2016/158971 | 10/2016 | |

* cited by examiner

FLUID METHOD AND SYSTEM

This application is a National Phase application of, and claims the benefit of, International (PCT) Application No. PCT/US2016/053371, filed Sep. 23, 2016, which claims priority to GB Patent Application No. 1516864.4, filed Sep. 23, 2015, each of which is hereby incorporated by reference in its entirety.

This invention relates to a method for use with a fluid container, particularly a fluid container for supplying fluid to a fluid circulation system of a vehicle engine or a vehicle. Many vehicle engines use one or more fluids for their operation. Such fluids are often liquids. For example, internal combustion engines use liquid lubricating oil compositions. Also, electric engines use fluids which can provide heat exchange functionality, for example to cool the engine, to heat the engine or to cool and heat the engine during different operating conditions. The heat exchange functionality of the fluids may be provided in addition to other functions (such as a primary function) which may include for example charge conduction and/or electrical connectivity. Such fluids may be generally held in containers associated with the engine.

The containers may be filled and may be recycled and/or refilled.

Aspects of the present disclosure are recited in the independent claims. Optional features are recited in the dependent claims.

Embodiments of the invention will now be described, by way of example only, with reference to the accompanying drawings, in which.

In the drawings, like reference numerals are used to indicate like elements.

Figure 1A:
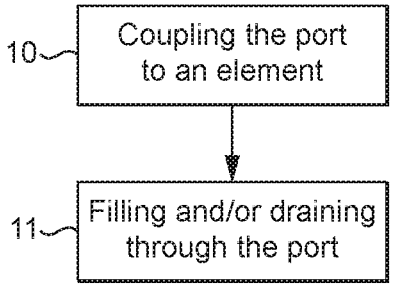
FIG. 1A shows a schematic block diagram of a first example of a method of filling and/or draining a replaceable fluid container for a vehicle or engine.
Figure 1B:
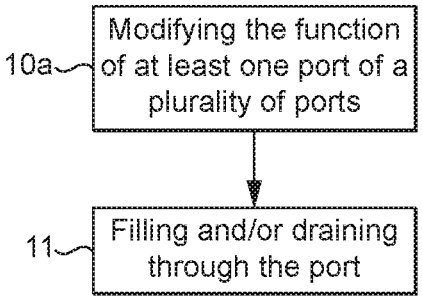
FIG. 1B shows a schematic block diagram of a second example of a method of filling and/or draining a replaceable fluid container for a vehicle or engine.
Figure 7:
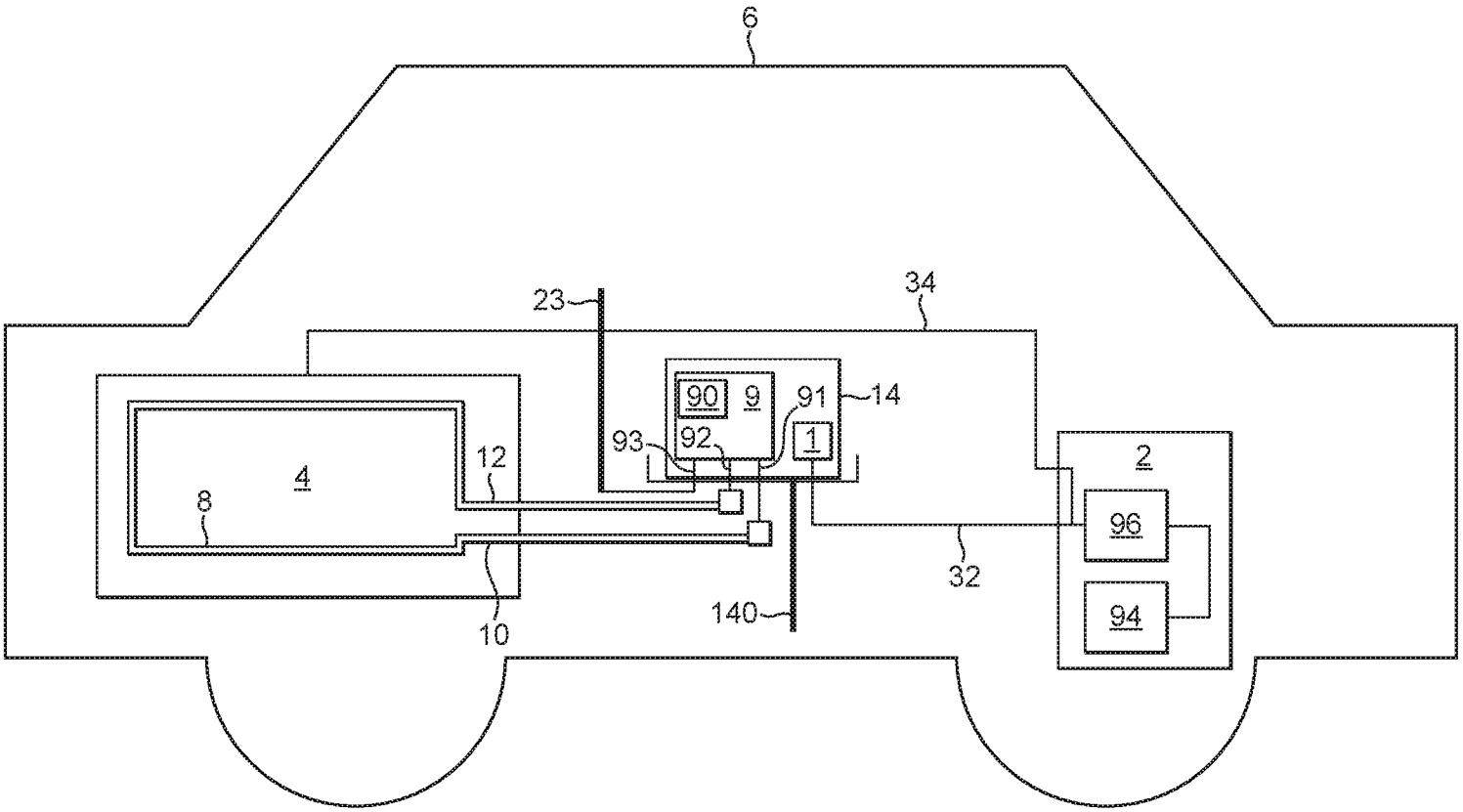
FIG. 7 shows a schematic illustration of a vehicle with a replaceable fluid container docked with a dock.

Embodiments disclosed with reference to the Figures, for example with reference to FIGS. 1A, 1B and 7, provide a method of filling and/or draining a replaceable fluid container 14 (as shown for example in FIG. 7) for a vehicle 6 (as shown in FIG. 7) or an engine 4 (as shown for example in FIG. 7).

As described in greater detail below, the replaceable fluid container 14 may comprise a fluid reservoir 9 and at least one port.

In the example shown in FIG. 7, the container 14 has three ports, i.e.:

a fluid outlet port 91 (sometimes referred to as a "supply port"), a fluid inlet port 92 (sometimes referred to as a "return port"), and a vent port 93 (sometimes referred to as a "breather port").

In the example of FIG. 7, the container 14 is configured to couple with a cooperating dock 140 associated with the vehicle 6 or the engine 4, to place the reservoir 9 in fluidic communication with a fluid circulation system 8 associated with the vehicle 6 or engine 4 when the replaceable fluid container 14 is docked with the dock 140.

In some examples, the reservoir 9 may be a specific chamber or the fluid may simply be held in the container.

In the present disclosure, and as explained in further detail below, "replaceable" means that:

the container can be supplied to the vehicle 6 or the engine 4, full with fresh and/or unused fluid, and/or the container can be inserted in and/or seated in and/or docked with the dock 140, in a non-destructive manner, and/or the container can be coupled to the fluid circulation system 8, in a non-destructive manner, and/or the container can be removed from the dock, in a non-destructive manner, i.e. in a manner which enables its re-insertion in the dock 140 should that be desired, and/or the same (for example after having been refilled) or another (for example full and/or new) container can be re-inserted in and/or re-seated in and/or re-docked with the dock 140, in a non-destructive manner.

It is understood that the term "replaceable" means that the container may be "removed" and/or "replaced" by another new container and/or the same container after having been refilled (in other words the replaceable container may be "refillable") which may be re-inserted in the dock or re-coupled to the fluid circulation system.

In the present disclosure, "in a non-destructive manner" means that integrity of the container is not altered, except maybe for breakage and/or destruction of seals (such as seals on fluid ports) or of other disposable elements of the container.

In the example of FIG. 7, the fluid outlet port 91 is configured to couple with the fluid circulation system 8 and to provide fluid from the fluid reservoir 9 of the fluid container 14. In the example of FIG. 7, the fluid is provided via a supply line 10.

In the example of FIG. 7, the fluid inlet port 92 is configured to couple with the fluid circulation system 8 to receive fluid that has circulated, e.g. in the engine 4, into the fluid reservoir 9. In the example of FIG. 7, the fluid is returned via a fluid return line 12.

The ports 91, 92 of the fluid container 14 may comprise self-sealing couplings or any other suitable form of couplings. The dock 140 and container 14 together may provide a releasable fastening mechanism, for example a locking mechanism, to hold the container 14 docked with or to the dock 140.

In the example shown in FIG. 7, in addition to the outlet port 91 and the inlet port 92, the container 14 may have the vent port 93 configured to couple with a vent 23 of the fluid circulation system 8 or the vehicle 6 to enable pressure relief as fluid is drawn into and out from the reservoir 9. In some examples, the vent port 93 may be configured to couple with a vent tube located in the reservoir 9 and extending inwards the reservoir 9, to enable pressure relief as fluid is drawn into and out from the reservoir 9. In some examples, the vent tube may comprise a breather end, located in the reservoir 9 above a level corresponding to a predetermined volume of fluid in the reservoir (such as a nominal volume of fluid in the container), to enable pressure relief as fluid is drawn into and out from the reservoir 9.

As illustrated in FIG. 7 the fluid container 2 may comprise a filter 90.

Figure 8:
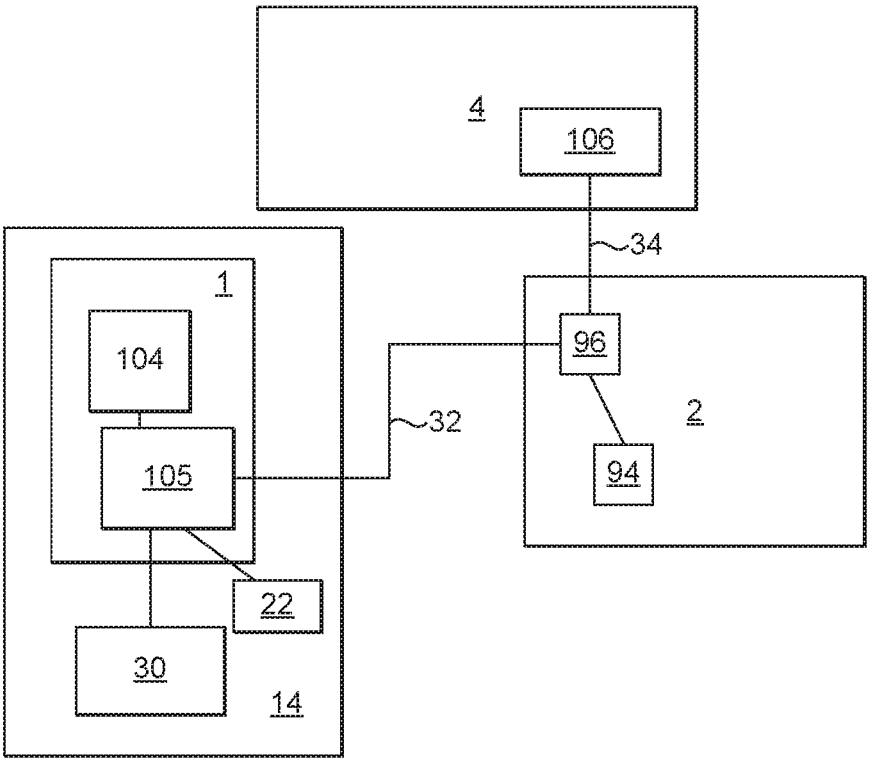
FIG. 8 shows a schematic block diagram of an engine fluid circulation system for the vehicle or engine.

In the example shown in FIG. 8, the fluid container 14 may have a connection sensor 30 for sensing when the fluid container 14 is docked and is in fluid communication with the fluid circulation system 8. The fluid container 14 may have a fluid sensor 22 (also shown in FIG. 4A) to sense at least one characteristic of the fluid in the container.

Figure 3:
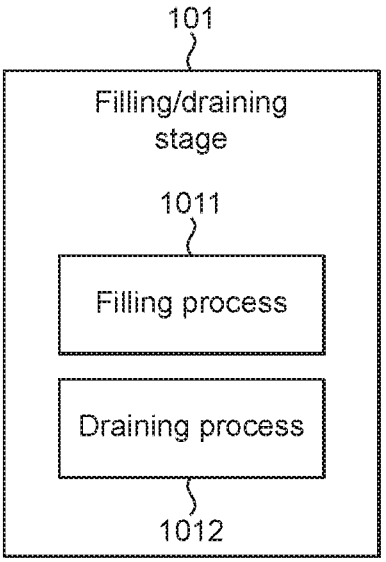
FIG. 3 shows a schematic illustration of the filling and/or draining stage of FIG. 1.
Figure 4A:
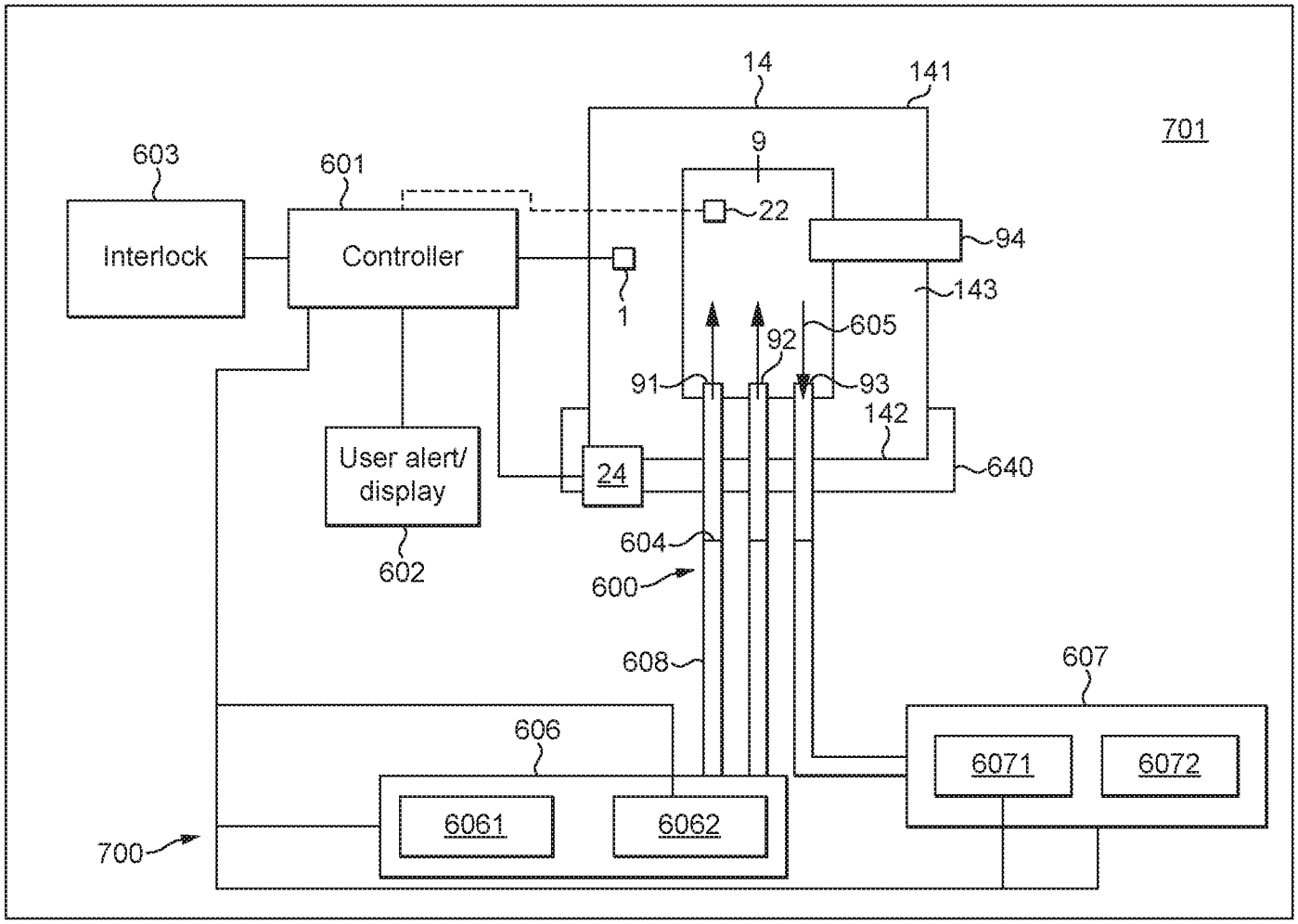
FIG. 4A shows a schematic illustration of an example filling and/or draining system for carrying out the filling and/or draining stage of FIG. 3, with one example container.
Figure 4B:
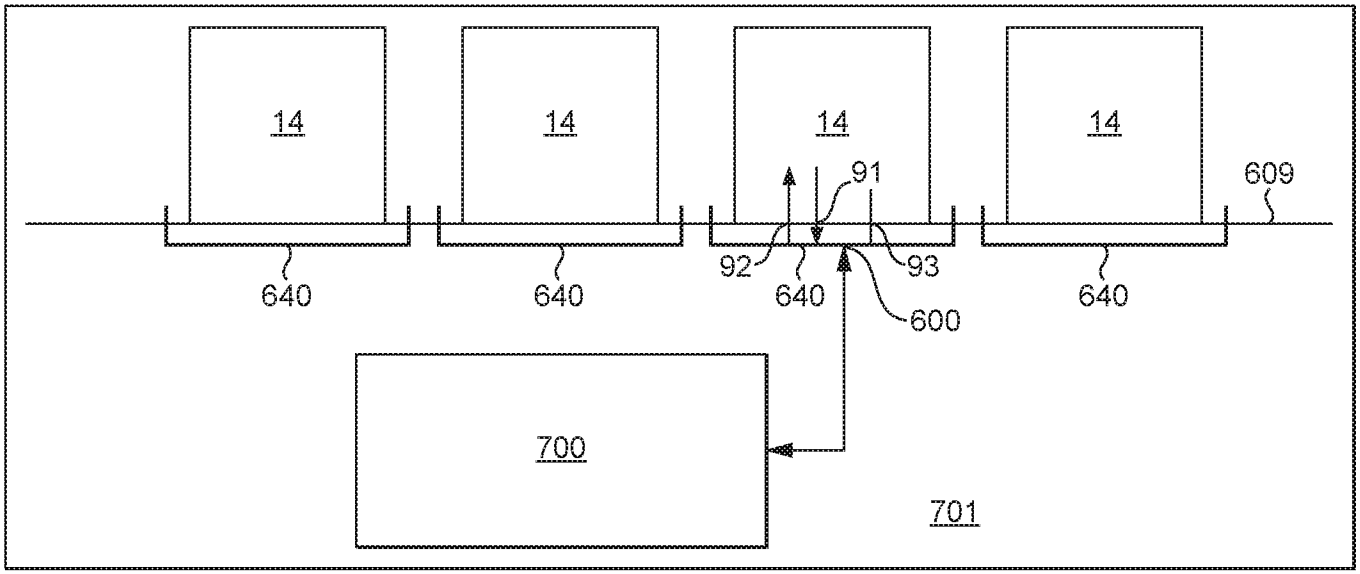
FIG. 4B shows a schematic illustration of an example filling and/or draining system for carrying out the filling and/or draining stage of FIG. 3, with a plurality of example containers.

With reference to FIGS. 4A and 4B, embodiments of the disclosure provide a method, as illustrated in FIG. 1A, which comprises:

coupling, at 10, at least one of the ports (e.g. the port 91, the port 92 or the port 93) of the replaceable fluid container 14 to a cooperating filling and/or draining element 600 (as shown in FIG. 3) of a filling and/or draining system 700 of a replaceable fluid container management facility 701 to place the container 14 or the reservoir 9 in fluidic communication with the filling and/or draining system 700; and filling and/or draining, at 11, the fluid reservoir through the port.

The container may have a plurality of ports 91, 92 and 93. Each of the plurality of container ports has an operational function. The operational function of each respective container port is a function served by the respective port during operation of the replaceable fluid container in the engine or vehicle. The operational function of a container port may be described herein as the port's "first function". At least one of the plurality of ports has a first function of supplying fluid from or of allowing supply of fluid to the reservoir 14 (e.g. the fluid outlet port 91 or the fluid inlet port 92, respectively).

With reference to FIGS. 4A and 4B, embodiments of the disclosure provide a method, as illustrated in FIG. 1B, which comprises:

modifying, at 10*a*, an operational, or first, function of the at least one (e.g. the fluid inlet port 92 or the fluid outlet port 91) of the plurality of ports 91, 92 and 93, so that the modified port has a second function (different than the first function of supplying fluid from or of allowing supply of fluid to the reservoir 9 when the replaceable fluid container 14 is docked with the dock 140), to assist filling and/or draining of the reservoir; and optionally filling and/or draining, at 11, the fluid reservoir through the port (e.g. the fluid inlet port 92).

In some examples, modifying the operational function of at least one of the plurality of ports may comprise modifying the operational function of at least one of the fluid inlet port or the fluid outlet port. In some examples, modifying the operational function of at least one of the plurality of ports may comprise blocking the fluid inlet port. In some examples, the method may comprise opening the fluid inlet port and maintaining it open during filling and/or draining of the fluid container.

An example of a filling and/or draining of the fluid container 14 will now be described with aid of FIGS. 2 and 3.

The container 14 may be Tillable and/or may be recyclable and/or refillable.

Figure 2:
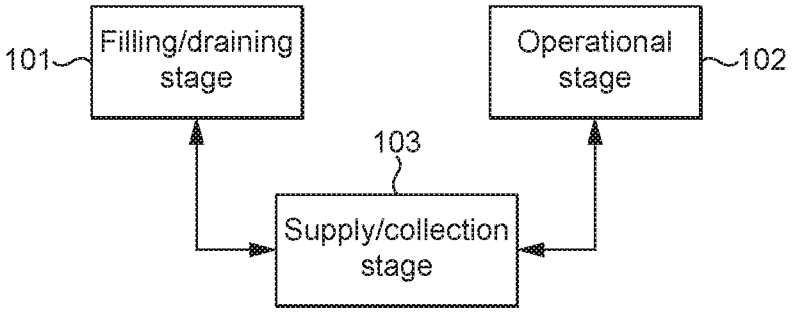
FIG. 2 shows a diagram of example stages of a lifecycle of a replaceable container, the example stages comprising a filling and/or draining stage.

As illustrated diagrammatically in FIG. 2, a lifecycle of the fluid container 14 may for example comprise at least one or more of:

a filling and/or draining stage 101 in which the replaceable container is filled with the fluid or drained of used fluid in the replaceable fluid container management facility 701 (illustrated e.g. in FIGS. 4A and 4B); and an operational stage 102 in which the replaceable container is in use in the vehicle 6.

It should be understood that a drained replaceable fluid container can be refilled. The lifecycle of the container may thus comprise a collection and/or supply stage 103 in which the used containers are collected to be drained, for example at a point of collection such as a garage or shop or a dedicated collection point, and in which refilled (also referred to as the "recycled") containers are supplied, for example to a point of sale such as a garage or shop or perhaps even back to the same vehicle user or owner, for use in a vehicle or engine.

As shown in FIG. 3, the filling and/or draining stage 101 provides a number of processes through which a particular container may pass, which may, in some non-limiting examples, depend upon data associated with at least one of the container, its contents and the vehicle or the engine.

As shown these processes may include:

a fluid filling process 1011 and a fluid draining process 1012.

It should be understood that, in some examples, the fluid filling process 1011 may be performed, at least partly, in a first management facility 701 and the fluid draining process 1012 may be performed, at least partly, in a second management facility 701.

In some examples, the first management facility 701 may be different from the second management facility 701, or may form, at least partly or completely, part of the second management facility 701. Similarly, the second management facility 701 may form, at least partly or completely, part of the first management facility 701.

In some examples, the fluid filling process 1011 and the fluid draining process 1012 may be performed by a same system 700 or performed respectively by different systems 700.

Referring now to FIGS. 4A and 4B, a filling and/or draining system 700 may be configured to perform at least some of the steps of the method shown in FIGS. 1A and 1B. In the example of FIGS. 4A and 4B, the system 700 comprises at least one filling and/or draining element 600. In some examples described in greater detail below, the system 700 may comprise a plurality of elements 600. In some examples, the plurality of elements may be configured to provide a different element 600 to each port of the container.

In the example of FIGS. 4A and 4B, the system 700 is located in the management facility 701.

In the example of FIGS. 4A and 4B, the container 14 is configured to be associated with the element 600. In the example illustrated by FIG. 4A, the element 600 is configured to place, as explained in greater detail below, the fluid reservoir 9 in fluidic communication with components of the filling and/or draining system 700. In the example of FIGS. 4A and 4B, the coupling of the element 600 and the container 14 is such that, when the fluid reservoir 9 is in fluidic communication with the filling and/or draining system 700, the replaceable fluid container 14 is in the same orientation as when it is docked with the dock 140 as described with reference to FIG. 7. In the example of FIGS. 4A and 4B, the replaceable fluid container 14 is oriented such that the bottom of the container 14 (comprising the ports 91, 92 and 93) is docked with the dock 140. In the example of FIGS. 4A and 4B, the port 91 or 92 or 93 is located on the replaceable fluid container 14, such that the fluid reservoir 9 is positioned above the port 91 or 92 or 93 when the replaceable fluid container 14 is coupled with the filling and/or draining element 600 (or e.g. docked with the dock 140 as shown in FIG. 7).

It should be understood that the filling and/or draining system 700 (comprising the element 600) may be configured to fill and/or drain the fluid reservoir 9 through the port 91 or 92 when the container 14 is coupled with the filling and/or draining element 600 in the same orientation as when it is docked with the dock 140 (as described with reference to FIG. 7). In some examples, when the container 14 is coupled with the element 600 in the same orientation as when it is docked with the dock 140 (as described with reference to FIG. 7), the element 600 may be configured to prevent or at least inhibit contamination (e.g. flooding) of the vent port 93 with fluid. In some examples, when the container 14 is coupled with the element 600 in the same orientation as when it is docked with the dock 140, the element 600 may be configured to block the vent port 93. Alternatively or additionally, in some examples, when the container 14 is coupled with the element 600 in the same orientation as when it is docked with the dock 140 (as described with reference to FIG. 7), the vent tube coupled with the vent port 93 is not contaminated (e.g. flooded) when fluid is filled into and/or drained out of the reservoir 9, because the bottom of the container 14 comprising the ports 91 and 92 is positioned below the fluid reservoir 9. In some examples, such an orientation enables the breather end of the vent tube coupled with the vent port 93 to be located above the bottom of the container 14 (comprising the ports 91 and 92), and enables the breather end of the vent tube not to be contaminated (e.g. flooded) when fluid is filled into and/or drained out of the reservoir 9. In such examples, the filling and/or draining of the container 14 may be performed from underneath the reservoir 9. In some examples, when the container 14 is coupled with the element 600 in the same orientation as when it is docked with the dock 140, the element 600 may be configured to enable (e.g. by blocking the vent port 93) the vent port 93 and/or the vent tube (when a vent tube is coupled with the vent port 93) to form an air-lock to prevent or at least inhibit contamination (e.g. flooding) of the vent port 93 and/or the vent tube (when a vent tube is coupled with the vent port 93) with fluid.

In the example of FIG. 4A, the replaceable fluid container may optionally comprise an aperture 94 (for example a closeable aperture, e.g. comprising a removeable screw cap) spaced from the port 91 or 92 or 93, and through which the removable fluid container may be filled and/or drained.

In the example of FIG. 4A, the replaceable fluid container 14 has a plurality of walls. The walls include:

a first wall 141 which is uppermost when the replaceable fluid container is coupled with the element 600 (or docked with the dock 140), a second wall 142 which is lowermost when the replaceable fluid container 14 is coupled with the element 600 (or docked with the dock 140), and a sidewall or sidewalls 143.

In the example of FIG. 4A, the aperture 94 extends through the sidewall 143 of the replaceable fluid container 14. Additionally or alternatively, the container may comprise an aperture (not shown in the Figures) through the first wall 141 of the replaceable fluid container 14.

In some examples, the element 600 may simply be the coupling to the fluid reservoir 9. To that effect, the element may comprise at least one port 604 configured to cooperate with at least one port of the container 14.

In the example illustrated by FIG. 4A, the element 600 comprises a port actuator 605 to:

disable (e.g. close or maintain closed) a fluid port (and/or any corresponding valves as explained below) of the container 14 for inhibiting outflow of fluid from the container 14, and activate (e.g. open or maintain open) a fluid port (and/or any corresponding valves as explained below) of the container 14 for enabling the fluid to flow through the port into the container 14.

The port actuator 605 may comprise a mechanical component, such as a component configured to cooperate with the ports 91, 92 or 93 of the container 14. For example where the ports 91, 92 or 93 comprise a female component, as illustrated in FIG. 4A, the port actuator 605 comprises a male component (such as a nozzle). In some examples, the male component may be configured to activate the fluid ports 91, 92 or 93 of the container 14.

Additionally or alternatively, the port actuator 605 may have an electromagnetic actuator, for example actuated by a solenoid. Additionally or alternatively, the port actuator 605 may have a hydraulic or pneumatic actuator which is configured to actuate the port of the fluid container by a pressurized fluid (such as oil and/or a gas (such as vapour and/or air)) provided through a pipework 608, as illustrated in FIG. 4A.

It should be understood that the port 604 of the element 600 may comprise self-sealing couplings or any other suitable form of couplings or valves. In some examples, the port actuator 605 may comprise a self-sealing coupling which may comprise a self-sealing valve which is biased to a closed position, when the container 14 and the element 600 are disconnected. In some non-limiting examples, the valve may comprise an axially moveable element and a valve face which may, when in the closed position, rest against a valve seat of the port actuator 605, in order to seal the element 600 to prevent or at least inhibit fluid flow through the closed valve. When the valve is in the open position, the valve face does not rest against the valve seat, and thus allows fluid to flow through the open valve. It should be understood that other types of self-sealing coupling may be envisaged. It should be understood that the port 604 of the element 600 (or the couplings of the element 600) does not necessarily comprise self-sealing couplings or valves.

In some examples, the element 600 may comprise a coupling plate or mount. In some examples, the element 600 may comprise a dedicated reception station 640 designed to receive at least a portion of the fluid container. In the example shown in FIG. 4A, the reception station 640 may be similar to the dock 140 associated with the engine 4 or provided in the vehicle 6 shown in FIG. 7.

In the example illustrated by FIG. 4A, the system 700 comprises:

a fluid unit 606;

a vent unit 607, and the pipework 608, configured to fluidically connect the element 600 to the fluid unit 606 and the vent unit 607, respectively.

In the example illustrated by FIG. 4A, the fluid unit 606 comprises a fluid tank 6061 and a reversible pump 6062. In some examples, the pump 6062 may be configured to:

provide, during the filling process 1011, fluid from the tank 6061 to the container 14 via the pipework 608 of the element 600; and drain, during the draining process 1012, fluid to the tank 6061 from the container 14 via the pipework 608 of the element 600.

It should be understood that in examples where the system 700 performs only one of the filling process or the draining process, the pump 6062 need not necessarily be reversible.

In some non-limiting examples, the power of the pump 6062 may be suitable to pump the fluid at a rate of about 1 L/second (other rates are envisaged, for example higher rates). In examples where the fluid container 14 has a reservoir of about 4-5 L, the system 700 may be configured to fill or drain the container 14 in about 4 or 5 seconds.

In some examples, the pump 6062 may be configured to:

fill and/or drain a portion (e.g. a major portion, e.g., 90%, but other portions are envisaged) of the volume of the fluid reservoir 9 at a first rate (for example at a rate of about 1 L/second, but other rates are envisaged), and subsequently fill and/or drain at least some of the remaining volume (e.g., a minor portion, e.g., 10%, but other portions are envisaged) of the fluid reservoir at a second rate (for example at a rate of about 0.5 L/second, but other rates are envisaged).

As described above, in some examples the second rate is slower than the first rate, but the second rate could be higher than the first rate.

In some examples the system 700 may be configured to:

end the filling and/or draining process; and/or switch from the first rate to the second rate after a predetermined time period (such as a few seconds, depending on the power of the pump 6062).

In the example of FIG. 4A, the filling and/or draining system 700 comprises a controller 601. In the example illustrated by FIG. 4A, the controller 601 is connected to the fluid unit 606. The controller 601 shown in FIG. 4A is connected to the pump 6062.

In some examples, the controller 601 may be configured to:

determine a time lapsed during the filling process 1011 and/or the draining process 1012, and to end the filling process 1011 and/or the draining process 1012 when the lapsed time reaches the predetermined time period.

Additionally or alternatively, as non-limiting examples, the system 700 may be configured to:

sense an amount of fluid in the fluid container 14; and/or measure an amount of fluid and/or gas (such as air or vapour) going into and/or coming out of the container 14; and/or measure a pressure across the filter.

In the example of FIG. 4A, the system 700 may comprise a weight sensor 24 configured sense, e.g. in real time, the weight of the container 14. It should be understood that the sensed amount of fluid could be sensed by another sensor of the system 700, such as a flow sensor.

In the example illustrated by FIG. 4A, the controller 601 is connected to the weight sensor 24 and may be configured to select or modify at least one of the rate and the time period of filling and/or draining the fluid reservoir in response to the sensed amount. The controller 601 shown in FIG. 4A may be configured to stop the filling and/or draining the fluid reservoir in response to the sensed amount.

In the example illustrated by FIG. 4A, the vent unit 607 comprises a vent 6072 (and optionally a reversible pump 6071). In some examples, the pump 6071 may be configured to:

provide, during the draining process 1012, gas from the vent 6072 to the container 14 via the pipework 608 of the element 600; and extract, during the filling process 1011, gas to the vent 6072 from the container 14 via the pipework 608 of the element 600.

The controller 601 shown in FIG. 4A is connected to the unit 607. The controller 601 shown in FIG. 4A is connected to the pump 6071.

It should be understood that in examples where the system 700 performs only one of the filling process or the draining process, the pump 6071 need not necessarily be reversible.

In some examples, the vent 6072 may be fluidically connected to a tank or open to an ambient atmosphere, for example via a filter.

In some examples, the pump 6071 and/or 6062 may be operated independently or simultaneously (in that example the pump 6071 may assist the pump 6062 in the filling process 1011 and/or the draining process 1012). The pump 6071 and/or the pump 6062 shown in FIG. 4A may be controlled by the controller 601.

As described in greater detail below, during the filling and/or draining stage 101, in order to fill the container 14, the system 700 activates and disables the ports in a controlled manner, e.g. by the controller 601 shown in FIG. 4A.

In the example of FIG. 4A, as already stated, when the container 14 is coupled, at 10 of FIG. 1A, with the element 600 in the same orientation as when it is docked with the dock 140, e.g. so that the reservoir 9 is above the ports 91, 92 and 93 (as described with reference to FIG. 7), the element 600 may be configured to prevent or at least inhibit contamination (e.g. flooding) of the vent port 93 with fluid.

It should be understood that the container 14 may have a plurality of ports 91, 92 and 93, and that, in the examples of FIGS. 4A and 4B, in another aspect of the disclosure, an operational or first function of the at least one of the plurality of ports (e.g. the fluid inlet port 92 or the fluid outlet port 91) may be modified, at 10*a* of FIG. 1B, so that the modified port has a second function different than a first function, where the first function is:

supplying fluid from the reservoir 9 when the replaceable fluid container 14 is docked with the dock 140 (e.g. the fluid outlet port 91); or allowing supply of fluid to the reservoir 9 when the replaceable fluid container 14 is docked with the dock 140 (e.g. the fluid inlet port 92) to assist filling and/or draining of the reservoir.

With reference to FIGS. 1B and 4A, in some examples, modifying, at 10*a* of FIG. 1B, the function of at least one of the ports comprises:

opening the fluid inlet port 92 and the fluid outlet port 91, and filling the fluid reservoir through both the fluid inlet port 92 and the fluid outlet port 91 and/or draining the fluid reservoir through both the fluid inlet port 92 and the fluid outlet port 91 (to enable more rapid filling and/or draining of the fluid reservoir so that the fill or drain times can be reduced).

With reference to FIGS. 1B and 4B, in some examples, modifying, at 10*a* of FIG. 1B, the function of at least one of the ports comprises:

opening the fluid inlet port and the fluid outlet port, and filling and/or draining the fluid reservoir through one of the fluid inlet port and the fluid outlet port (e.g. the inlet port 92) whilst allowing air to enter or exit the replaceable fluid container 14 through the other of the fluid inlet port and the fluid outlet port (e.g. the outlet port 9) to regulate the internal pressure of the replaceable fluid container during filling and/or draining of the fluid reservoir.

With reference to FIGS. 1B and 4A, in some examples, gas (such as air and/or vapour) which is pushed by the incoming fluid pumped by the pump 6062 (and/or extracted by the pump 6071) is allowed to escape the container 14 through the breather port 93. Similarly, in that example, gas (such as air and/or vapour) which is drawn in by the outflow of fluid pumped by the pump 6062 (and/or the pump 6071) is allowed to enter through the breather port 93.

With reference to FIGS. 1B and 4B, in some examples, modifying, at 10*a* of FIG. 1B, the function of at least one of the ports may comprise:

blocking the breather port 93 during filling and/or draining of the fluid reservoir when both the inlet port and the outlet port are open and gas (such as air of vapour) may pass through one of the inlet port and the outlet port. This may avoid contamination (e.g. flooding) of the breather port with the fluid.

In some examples, the method may comprise filling the fluid reservoir through both the fluid inlet port and the fluid outlet port simultaneously and/or draining the fluid reservoir through both the fluid inlet port and the fluid outlet port simultaneously.

In the example illustrated by FIG. 4B, the element 600 comprises a plurality of container reception stations 640 which can be provided on a conveyor 609 or other transport system provided at the stage 101, at the management facility 701. A plurality of containers 14 may be passed through the stage 101 (illustrated in FIG. 2), sequentially (when the facility comprises e.g. only one system 700 or conveyor 609) or in parallel (when the facility comprises e.g. a plurality of systems 700 or conveyors 609).

While the above describes the replaceable fluid container 14 coupling directly to the filling and/or draining elements 600 of the filling and/or draining system 700, in other examples, the container 14 may be coupled to the filling and/or draining system 700 indirectly, for example via a filling and/or draining interface plate.

In embodiments, the filling and/or draining interface plate is configured to interface between the replaceable fluid container 14 and the filling and/or draining system 700. In these embodiments, the container 14 may be coupled to filling and/or draining elements 600 of the filling and/or draining system 700 via the interface plate or to one or more other components of the filling and/or draining system 700 via the interface plate.

Figure 5B:
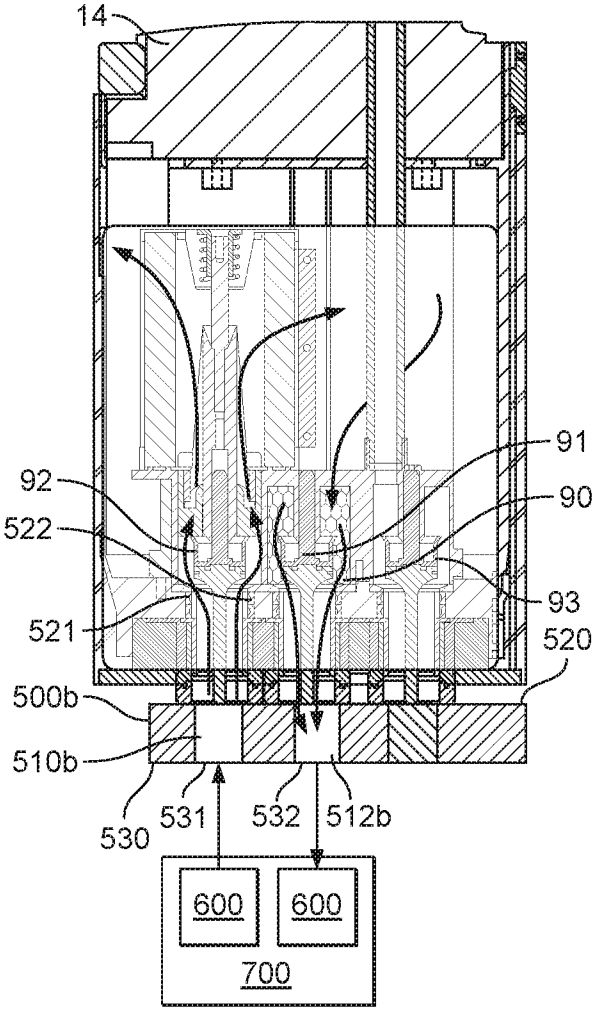
FIG. 5B shows a schematic illustration of a second example of a filling and/or draining interface plate for interfacing between a replaceable fluid container and a filling and/or draining system, shown coupled to a replaceable fluid container comprising three ports.
Figure 5A:
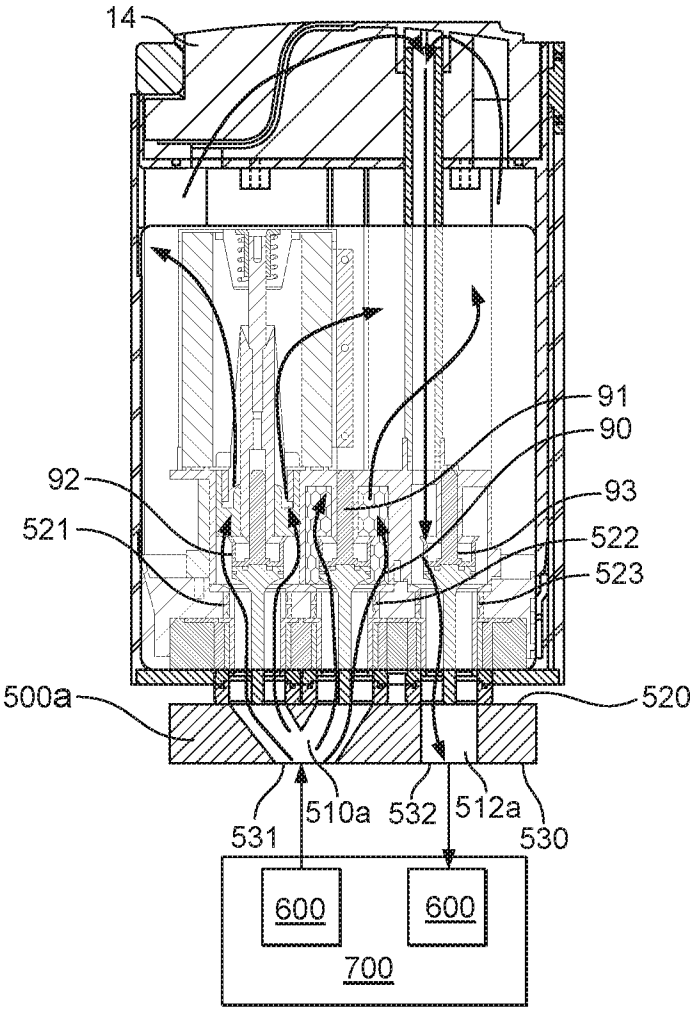
FIG. 5A shows a schematic illustration of a first example of a filling and/or draining interface plate for interfacing between a replaceable fluid container and a filling and/or draining system, shown coupled to a replaceable container comprising three ports.

With reference to FIGS. 1B and 5A and 5B, in some examples and as described in greater detail below, modifying, at 10*a* of FIG. 1B, the function of at least one of the ports comprises:

coupling the filling and/or draining interface plate 500 between the replaceable fluid container 14 and the filling and/or draining system 700 of the replaceable fluid container management facility 701, such that the interface plate 500 couples at least one of the plurality of ports of the replaceable fluid container 14 to at least one of the plurality of filling and/or draining elements 600 of the filling and/or draining system 700.

In some examples, the interface plate may be configured to control the couplings of the container ports 91, 92, 93 to one or more filling and/or draining elements 600 or one or more fluid lines of the filling and/or draining system 700, for example by controlling opening and closing of one or more of the ports.

In embodiments, the filling and/or draining interface plate may be provided between the container 14 and the system 700. The filling and/or draining interface plate may be configured to control the couplings of the ports to the fluid system, for example by controlling the coupling of each port to one or more elements.

In embodiments, a filling and/or draining interface plate is configured to modify the function of at least one of the ports 91, 92, 93, for example to assist a filling and/or draining operation. In embodiments, the filling and/or draining interface plate is configured to modify the function of a port, from a first function, such as a primary function (such as a function of the port when the container 14 is in use in a vehicle or engine as described herein), to a second function different than the first function.

A modified port function (e.g. the second function) may be provided to assist filling and/or draining of the fluid reservoir 9.

A modified port function may be provided to avoid or reduce contamination of the breather port 93 with the fluid during filling and/or draining of the fluid reservoir 9.

In embodiments, the fluid inlet port 92 has the first function of controlling the inflow of fluid into the fluid reservoir 9.

In embodiments, the fluid outlet port 91 has the first function of controlling the outflow of fluid from the fluid reservoir 9.

In embodiments, the breather port 93 has the first function of enabling a flow of air into and/or out of the removable fluid container 14, for example into or out of the fluid reservoir 9, for example to regulate the internal pressure of the replaceable fluid container 14 during filling and/or draining of the fluid reservoir 9.

FIG. 5A shows a first example of a filling and/or draining interface plate 500*a* arranged for interfacing between a filling and/or draining system 700 and a replaceable fluid container 14.

The filling and/or draining interface plate 500*a* of FIG. 5A may permit opening of both the fluid inlet and outlet ports 92, 91 to allow rapid filling or draining of the fluid reservoir 9. The plate may also permit opening of the breather port 93 to allow air displaced by the fluid during a filling operation to escape and/or to allow air to enter the container during a draining operation.

The filling and/or draining interface plate 500*a* has a first surface 520 and a second surface 530. The first surface 520 has first, second and third port actuators 521, 522, 523. The second surface 530 has first and second filling and/or draining system connections 531, 532.

A first channel 510*a* extends through the interface plate 500*a* from the first connector 531 to the first port actuator 521 and from the first connector 531 to the second port actuator 522, for example in a v-shape configuration.

A second channel 512*a* extends through the interface plate 500 from the second connector 532 to the third port actuator 523.

The first surface 520 is arranged to receive the replaceable fluid container 14 thereon and to cooperate with the ports 91, 92, 93 of the replaceable fluid container 14 when the container 14 is positioned on the interface plate 500*a*.

The first port actuator 521 is arranged to couple with the fluid inlet port 92 in order to control opening and/or closing of the fluid inlet port 92. The second port actuator 522 is arranged to couple with the fluid outlet port 91 in order to control opening and/or closing of the fluid outlet port 91. The third port actuator 523 is arranged to couple with the breather port 93 in order to control opening and/or closing of the breather port 93.

As already stated, each of the port actuators may comprise a mechanical component (such as a nozzle) and/or an electromagnetic actuator and/or a hydraulic or pneumatic actuator. In the example of FIG. 5A, each port actuator may be configured to open a container port 91, 92, 93 to which it couples as a consequence of the mechanical coupling, or it may it be controlled to open the port by a controller once the coupling has been established.

The second surface 530 is arranged to cooperate with one or more filling and/or draining elements 600 or one or more fluid lines of the filling and/or draining system.

The first filling and/or draining system connector 531 is configured to be coupled to a first filling and/or draining element 600 of the filling and/or draining system 700.

The second filling and/or draining system connector 532 is configured to be coupled to a second filling and/or draining element 600 of the filling and/or draining system 700 or directly to air.

The connectors 531, 532 may comprise ports and may be configured to couple to port actuators of the first and second filling and/or draining elements 600. In other examples, the first and second filling and/or draining elements 600 do not have port actuators and instead the connectors 531, 532 couple to fluid lines of the filling and/or draining elements 600.

In operation, the replaceable fluid container 14 is positioned on the interface plate 500*a* such that:

the fluid inlet port 92 is positioned on the first port actuator 521, the fluid outlet port 91 is positioned on the second port actuator 522, and the breather port 93 is positioned on the third port actuator 523.

The positioning of the respective ports on the respective port actuators couples the respective ports to the respective port actuators. In this example, the coupling of a given port to a given port actuator causes the port actuator to open the port.

The interface plate 500*a* places the fluid inlet port 92 and the fluid outlet port 91 in fluidic communication with the first filling and/or draining element 600 via the first channel 510*a*, and places the breather port 93 in fluidic communication with the second filling and/or draining element 600 via the second channel 512*a*.

In this example, the first filling and/or draining element 600 is configured to be, or is operated as, a filling element, that is to say an element 600 through which fluid is supplied to fill the reservoir 9. The second filling and/or draining element 600 is configured to be, or is operated as, a breather element, that is to say the element 600 is open or connected to an air supply to allow air to flow into or out of the reservoir 9.

The arrows in FIG. 5A illustrate a filling operation. Fluid is supplied through filling and/or draining element 600 into the first channel 510*a*, and into the fluid reservoir 9 via the fluid inlet port 92 and the fluid outlet port 91. Meanwhile, air passes out of the reservoir 9 through the breather port 93 and the breather element 600 as the reservoir 9 fills with fluid. This may help regulate the pressure within the fluid container 14 during the filling operation.

In this example, the coupling of the first connector 531 to the fluid inlet port 92 and the fluid outlet port 91 by way of the first channel 510*a* causes fluid to be supplied into the reservoir 9 through both of the fluid inlet and outlet ports 92, 91, thereby modifying the first of the fluid outlet port 91. By providing fluid to the reservoir 9 through both of the fluid inlet and the fluid outlet ports 92, 91, the reservoir 9 may be filled more rapidly than when filling through the fluid inlet port 92 alone.

The same interface plate 500*a* may be used during a draining operation on the fluid container 14. In this case, the first connector 531 is coupled to a filling and/or draining element 600 which is configured to be, or is operated as, a draining element, that is to say an element through which fluid is removed or drained from the reservoir 9. Draining the reservoir 9 through both the fluid inlet port 92 and the fluid outlet port 91 may allow the reservoir 9 to be drained at a faster rate than draining through the fluid outlet port 91 alone. Again, the breather port 93 allows air to flow into the container 14 as fluid exits the container to regulate the internal pressure of the container 14.

Whilst in the example of FIG. 5A the interface plate 500*a* couples the fluid inlet and outlet ports 92, 91 to a common filling and/or draining element, in other examples, the interface plate 500*a* may be configured to couple each of the fluid inlet and outlet ports to different respective filling and/or draining elements 600, and the filling and/or draining system 700 may still be operated to fill through both of the fluid inlet and outlet ports 92, 91 and/or to drain through both of the fluid inlet and outlet ports 92,91 concurrently.

Whilst in the above example the interface plate 500*a* couples the breather port 93 to a filling and/or draining element, in another example the interface plate 500*a* is configured to open the breather port 93 directly to air.

In a variation on the embodiment illustrated in FIG. 5A, an interface plate could be configured to connect each of the ports 91, 92, 93 to a filling and/or draining element 600, either by individual fluid channels or shared fluid channels such as the first fluid channel 512*a* in FIG. 5A, in order to allow each the filling or draining of the reservoir 9 through all of the ports. When, as in FIG. 5A, one of the ports is a breather port, this may involve running fluid through the breather port. In order to clear the breather port to allow it to optimally serve its first function, air could be caused to flow through the breather port to expel any fluid therein, for example by pumping a blast of air through the breather port, or applying a suction pressure to the breather port to cause air to flow through it.

FIG. 5B shows a second example of a filling and/or draining interface plate 500*b* arranged for interfacing between a filling and/or draining system 700 and a replaceable fluid container 14.

The filling and/or draining interface plate 500*b* of FIG. 5B may permit opening of both the fluid inlet and outlet ports 92, 91 to allow filling and/or draining through one of the fluid inlet and outlet ports 92, 91 and breathing/venting of air through the other of the fluid inlet and outlet ports 92, 91, whilst blocking the breather port 93 to allow filling and/or drain without flooding the breather port 93 with fluid.

The filling and/or draining interface plate 500*b* has a first surface 520 and a second surface 530. The first surface 520 has first and second port actuators 521, 522. The second surface 530 has first and second filling and/or draining system connections 531, 532. A first channel 510*b* extends through the interface plate 500*b* from the first connector 531 to the first port actuator 521. A second channel 512*b* extends through the interface plate 500*b* from the second connector 532 to the second port actuator 522.

The first surface 520 is arranged to provide a seat for the replaceable fluid container 14 and to cooperate with the ports of the replaceable fluid container 14 when the container 14 is positioned on the interface plate 500*b*.

The first port actuator 521 is arranged to couple with the fluid inlet port 92 in order to control opening and/or closing of the fluid inlet port 92. The second port actuator 522 is arranged to couple with the fluid outlet port 91 in order to control opening and/or closing of the fluid outlet port 91.

The second surface 530 is arranged to cooperate with one or more filling and/or draining elements 600 or one or more fluid lines of the filling and/or draining system.

The first filling and/or draining system connector 531 is configured to be coupled to a first filling and/or draining element 600 of the filling and/or draining system. In this example, the first filling and/or draining element 600 is configured to be, or is operated as, a filling element 600 as described above.

The second filling and/or draining system connector 532 is configured to be coupled to a second filling and/or draining element 600. In this example, the second filling and/or draining element 600 is configured to be, or is operated as, a breather element 600 as described above.

The connectors 531, 532 may comprise ports and may be configured to couple to port actuators of the first and second filling and/or draining elements 600. In other examples, the first and second filling and/or draining elements 600 do not have port actuators and instead the connectors 531, 532 couple to fluid lines of the filling and/or draining elements 600.

No actuator is provided for the breather port 93 and no channel is provided to allow air-flow to or from the breather port 93. The interface plate 500*b* thereby blocks, restricts or inhibits airflow through the breather port 93 when the container 14 is positioned on the interface plate 500*b*. This may prevent or reduce contamination of the breather port 93 with fluid during filling and/or draining of the reservoir 9.

In operation, the replaceable fluid container 14 is positioned on the interface plate 500*b* such that the fluid inlet port 92 is positioned on the first port actuator 521, the fluid outlet port 91 is positioned on the second port actuator 522 and the breather port 93 is blocked by the interface plate 500*b*. As described above, the positioning of the respective ports 91, 92, on the respective port actuators 521, 522 couples the respective ports to the respective port actuators and the coupling of a given port to a given port actuator may cause the port actuator to open the port.

The interface plate 500*b* places the fluid inlet port 92 in fluidic communication with the first filling and/or draining element 600 via the first channel 510*b*, places the fluid outlet port 91 in fluidic communication with the second filling and/or draining element 600 via the second channel 512*b* and restricts or blocks the breather port 93.

FIG. 5B illustrates a filling operation. Fluid is supplied through filling and/or draining element 600 into the first channel 510*b*, and into the fluid reservoir 9 via the fluid inlet port 92. Meanwhile, air passes out of the reservoir 9 through the fluid outlet port 91 and out of the breather element 600 as the reservoir 9 fills with fluid. This facilitates regulation the pressure within the fluid container 14 during the filling operation while the breather port 93 is restricted or blocked.

In this example, modifying the breather port 93 function by restricting or blocking the breather port 93 and modifying the fluid outlet port 91 function by allowing air to vent through the fluid outlet port 91 may protect the breather port 93 against contamination and potential blockage by the fluid whilst allowing the reservoir 9 to "breath" to regulate the pressure therein during a filling operation.

The same interface plate 500*b* may be used during a draining operation on the fluid container 14. In this case, the first connector is coupled to a filling and/or draining element 600 which is configured to be, or is operated as, a draining element, that is to say an element 600 through which fluid is removed or drained from to be drained from the reservoir 9. The fluid outlet port 91 may continue to provide a breather function.

In another example to that shown in FIG. 5B, a third port actuator could be provided on the first surface 520 for controlling actuation of the breather port 93. In this example, the interface plate 500*b* could be configured to restrict or block the breather port 93 irrespective of whether or not the third port actuator opens the breather port 93, and/or the third port actuator could be controlled to keep the breather port 93 closed.

Figure 6:
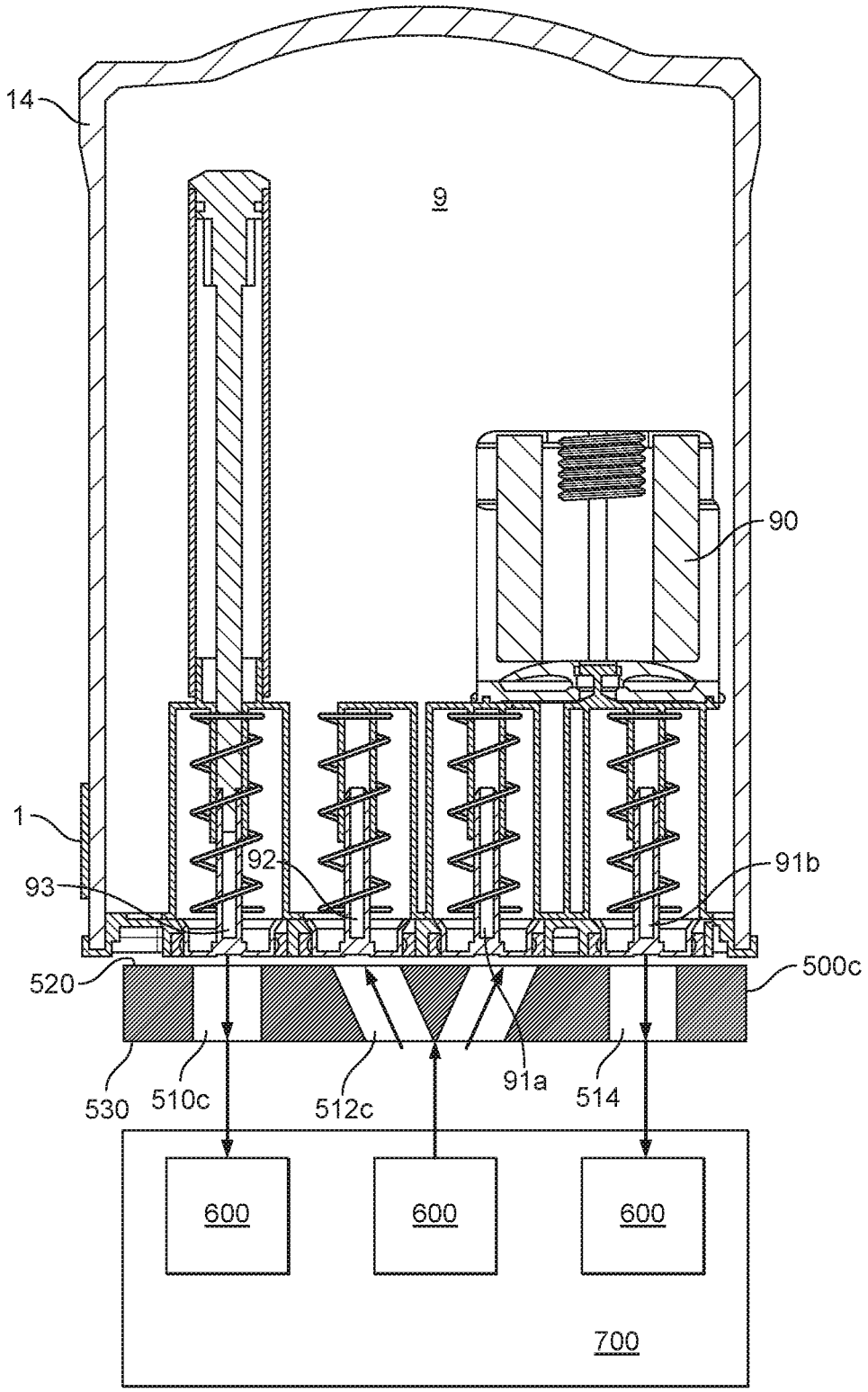
FIG. 6 shows a schematic illustration of a third example of a filling and/or draining interface plate for interfacing between a replaceable fluid container and a filling and/or draining system, shown coupled to a replaceable fluid container comprising four ports.

FIG. 6 shows an example of a filling and/or draining interface plate 500*c* arranged for interfacing between the filling and/or draining system 700 and a four-port replaceable fluid container 14. The four-port container 14 may be used in a dry sump engine, for example.

The interface plate 500*c* of FIG. 6 may allow rapid filling and/or draining through at least one fluid inlet port and at least one fluid outlet port, and effective breathing/venting through the breather port and a fourth port of the container (viewed from the other side than the containers of FIGS. 5A and 5B). The filling line interface plate 500*c* is configured to open all ports in the container allowing rapid fill or drain.

The replaceable fluid container 14 shown in FIG. 6 has four ports, of which one is a breather port 93, one is a fluid inlet port 92 and two are fluid outlet ports 91*a*, 91*b*. The fluid outlet ports 91*a*, 91*b* have a first function of supplying fluid to different limbs of a vehicle or engine fluid circulation system. The fluid outlet ports comprise a filter 90 for filtering outgoing fluid. In the illustrated example, a single filter 90 is provided across both of the fluid outlet ports 91*a*, 91*b* but in other examples, a separate filter could be provided for each.

The interface plate 500*c* may be configured and may operate similarly to the interface plate 500*a* of FIG. 5A. A first channel 510*c* is provided for coupling the breather port 93 to a first breather element 600 to allow the breather port 93 to serve its first function of pressure regulation. A second channel 512*c* is provided for coupling the fluid inlet port 92 and a first of the fluid outlet ports 91*a* to a filling element 600 to allow rapid fill of the reservoir 9. A third channel 514 is provided for coupling the second of the fluid outlet ports 91*b* to a second breather element 600 so that the second fluid outlet port 91*b* may provide a breathing/venting function to assist in regulating the pressure in the reservoir 9 during rapid filling (or draining) through the second channel. The reservoir 9 may be filled or drained via the second channel 512*c* by connecting the second channel 512*c* to a filling element 600 or a draining element 600 as appropriate, or by connecting the second channel 512*c* to a filling and/or draining element 600 which may be operated as a filling element 600 or a draining element 600.

In other examples than that of FIG. 6, a four-port container 14 could comprise any suitable combination of ports, such as:

a breather port, an outlet port and two inlet ports, or two breather ports, an inlet port and an outlet port.

One or more of the inlet or outlet ports could comprise a filter or a common filter could be shared between one or more of the inlet and outlet ports.

In one example, the first function of port 93 is a breather port, the first function of port 91*a* is a fluid inlet port, the first function of port 91*b* is a fluid outlet port, and the first function of port 92 is a fluid inlet and/or outlet port as may be selected according to a requirement of the fluid circulation system to which the container 14 is coupled. A further filter may be provided to filter fluid passing through port 92.

One or more or the above interface plates may be configured to open and/or close one or more of the container ports in a predetermined sequence. One or more of the container ports may be moved from an opened configuration to a closed configuration or vice versa to switch from a filling to a draining operation or vice versa or to change a function of one or more of the container ports.

In the described embodiments, a given filling and/or draining element may be configured to serve a single function, for example to "fill" the container by allowing fluid to flow towards, optionally comprising pumping fluid towards, the fluid container or to "drain" by allowing fluid to flow from, optionally comprising sucking fluid from, the fluid container, or it may be adapted to provide two or more different functions, such as filling then draining, according to the operation of other elements, such as pumps, in the fluid draining and/or circulation system.

By coupling two or more ports of the container to a single filling and/or draining element, the filling and/or draining system may be simplified, for example requiring fewer individual filling and/or draining elements and associated pumps.

Any of the interface plates described herein may be removably coupleable to the filling and/or draining system, may be integral or unitary with the filling and/or drainage system and/or may be removably coupleable to the fluid container or may be integral or unitary with the removable fluid container.

Any of the interface plates described herein may be provided as a kit of parts along with a removable fluid container and/or a filling and/or draining system or a part thereof.

Whilst the above embodiments describe the interface plates coupling container ports to respective filling and/or draining elements, in other examples, connectors of one or more of the interface plates may be configured to couple one more ports of the container to any suitable part of the filling and/or drainage system or, in the case of breather port connections, directly to an air supply such as ambient air.

In embodiments, the filling and/or draining elements may be arranged to extend through the interface plate or may be comprised in the interface plate.

In embodiments, the port actuators which are described above as being features of an interface plate may instead be components of the filling and/or draining system and may be arranged to extend through one or more channels of the interface plate to actuate respective container ports.

In embodiments described herein, the fluid reservoir could be at least partially expandable and/or collapsible to reduce the need for pressure regulation by way of one or more breather ports. This could allow a breather port to be omitted or to be used for, for example to be used only for, filling and/or draining of the fluid, for example.

A filter 90 may be provided with one or more ports of a given container 14. In the examples of FIGS. 5A and 5B, a filter is provided in across the respective fluid outlet ports 91 to filter the outgoing fluid. Optionally the filter 90 of any of the described examples may be pre-wetted (e.g. prefilled) with fluid to facilitate the fluid flow through the filter 90 during filling and/or draining. This may allow reduction of time of filling and/or draining through an otherwise dry filter 90 (a dry filter may provide a high resistance to a flow of fluid). Optionally the filter 90 may be pre-wetted (e.g. prefilled) with fluid to further reduce time to achieve a predetermined fluid pressure, following fitment of a new/refilled container on the vehicle 6.

In some embodiments, pre-wetting of the filter 90 may be achieved by filling the reservoir 9, at least initially, through a port which is not associated with the filter (such that fluid received through the port not associated with the filter drains into and fills the filter), after which the fluid may be allowed to flow through a port associated with the filter.

In some examples, a replaceable fluid container 14 which has a different number of ports than the containers 14 shown in the illustrated embodiments may be provided.

In the example of FIGS. 7 and 8, the fluid container 14 has a data provider 1 for providing data about the fluid container 14 and/or its contents. In this example, the data provider 1 is arranged to provide data to an engine control device 2 via a first communication link 32.

The data provider 1 of the fluid container 14 may, as shown in FIG. 8, comprise a processor 105 arranged to receive signals, e.g. from the fluid sensor 22 and the connection sensor 30, and to communicate data to the engine control device 2 via the communication link 32. The data provider 1 comprises a data store (memory) 104 for storing data describing or identifying at least one of the container and the fluid. In particular, the memory 104 may store data including at least one of (as non-limiting examples): the grade of fluid, the type of fluid, the date on which the fluid was filled, refilled or replaced, a unique identifier of the container 14 (such as a unique serial number of the container), an indication of whether the container is new, or has previously been refilled or replaced, an indication of the vehicle mileage, the number of times the container has been refilled or reused, and the total mileage for which the container has been used, and whether the container holds new or refilled fluid.

The controller 601 shown in FIG. 4A is arranged to read data (including e.g. control data) from at least one or more of:

the data provider 1 of the fluid container 14 (and perhaps also the sensor 22), a user alert (for example an audio or visual alert) and/or display 602 to provide information to an operator, and an interlock system 603 that may permit, inhibit or prevent processing of the fluid container and/or its contents by the stage 101 by mechanical or other means.

The controller 601 may be arranged to read data from the fluid sensor 22 to sense the amount of fluid in the fluid container 14. The filling and/or draining stage 101 may comprise selecting or modifying at least one of the rate and the time period of filling and/or draining the fluid reservoir in response to the sensed amount.

The controller 601 may be arranged to communicate with the data provider 1 carried by the container 14, to determine, on the basis of the communication with the data provider, data associated with at least one of the container, its contents and the vehicle and to control the filling and/or draining stage 101 in relation to at least one of the container and its contents on the basis of the data associated with at least one of the container, its contents and the vehicle.

At the filling and/or draining stage 101, the controller 601 may select:

a set of parameters (such as the type of fluid and/or the filling rate) for the filling process 1011 to be carried out on the empty (or drained) fluid container, dependent upon data determined by reading the data provider 1; and/or a set of parameters (such as the type of tank for the drained fluid and/or the draining rate) for the draining process 1012 to be carried out on the full fluid container, dependent upon data determined by reading the data provider 1; and/or another process to be carried out on the fluid container (such as sending the container to disposal or for further analysis).

For example if the read data indicates that the container 14 has not previously been recycled, or has been recycled less than a given number of times, the controller may add one to the recycle count in the data provider. For example, if the read data indicates that the container 14 has been recycled more than the given number of times, the controller 601 may send the container to a disposal process or may add information in the data provider indicating a readiness of the container for disposal.

Embodiments of the disclosure allow the filling and/or draining carried out to be appropriate to the specific container and/or its contents or the vehicle with which it is associated, so enabling, for example, filling and/or draining processes occurring in a lifecycle of the fluid container to be at least partially controlled or informed by data associated with at least one of the container, its contents and the vehicle and determined on the basis of the communication with the data provider. In some examples, the data provider may be reprogrammed during the filling and/or draining and/or the data integrity being checked, or may be reprogrammed in conjunction with (i.e. not necessarily during) the filling and/or draining and/or the data integrity being checked.

For example, a mechanical interlock may control, inhibit or prevent coupling with the reception station 640 by controlling a docking prevention mechanism to control coupling to the reception station 640 (if the reception station is similar to the dock 140 provided in the vehicle 6 shown in FIG. 7), so that access is denied in the event the data read from the data provider 1 indicates that one of the fluid or fluid container (or optionally the vehicle or vehicle make) is inappropriate for the stage 101. Such a mechanical interlock system 603 may have an electromagnetic actuator, for example actuated by a solenoid, itself controlled by the controller 601. In other cases, the interlock system 603 may be a software or communications interlock that controls, inhibits or prevents operation of the stage 101. As another possibility, the interlock system could be omitted and reliance placed, e.g. on the user of the alert and/or display 602.

In some examples, the reception station 640 and container 14 together may provide a releasable fastening mechanism, for example a locking mechanism, to hold the container 14 docked with or to the reception station 640 of the filling/draining system 700. In some examples, the releasable fastening mechanism (such as the locking mechanism) may form at least a part of the releasable fastening mechanism (such as the locking mechanism) also used to lock the container 14 to the dock 140 associated with the vehicle 6 (as shown in FIG. 7) or the engine 4 (as shown for example in FIG. 7).

In the example shown in FIG. 7, the fluid circulation system 8 is associated with the engine 4 and may be a lubricant system.

The replaceable fluid container 14 is removeably docked with the dock 140 on the vehicle 6, and is arranged to supply fluid to the fluid circulation system during operation of the vehicle. When initially docked with the vehicle, the replaceable fluid container 14 contains fluid.

The engine control device 2 comprises a processor 96, and a data store (memory) 94 configured to store control data for the engine 4 and possibly also other data, for example for supply to a device external to the vehicle. The processor 96 is configured to monitor and to control the operation of the engine 4, via a second communication link 34. The engine control device 2 is further configured to obtain data from the data provider 1 via the communication link 32 and may control the engine at least partly on the basis of data obtained from the data provider 1.

In this example, communication between the processor 96 and data provider 1 is enabled once the fluid container 14 is docked with the dock 140. Communication between the processor 96 and data provider 1 may also be enabled as the fluid container 14 approaches the dock 140, for example when the data provider 1 comes into wireless communication range, if the communications link 32 is a wireless one. The dock 140 may also have a data provider to enable communication of data to the processor 96 from the dock. The dock and the data provider or container may be able to communicate wirelessly and the dock may be able to communicate with the processor 96 via the communications link 32 to enable communication between the processor 96 and data provider 1 as the fluid container 14 approaches the dock.

The processor 96 is operable to compare data stored in the memory 94 with data obtained from the data provider 1 of the container 14 and from a communication interface 106 of the engine 4. For example, the processor 96 may be configured to compare:

data indicating the expected fluid level based on the mileage since the fluid was last refilled, and/or the fluid level sensed by the sensor 22, with stored data.

In the event that this comparison indicates that the fluid level is changing more quickly than expected, the control device 2 may modify a service interval for the vehicle based on this comparison.

The fluid may be any type of fluid ancillary to the vehicle's fuel such as a lubricant, or coolant, or de-icer, washer fluid, heat exchange, charge conduction and/or electrical connectivity, or any other fluid associated with the engine. As many different types and grades of such fluid are available, the data provider may comprise an identifier of the fluid.

The fluid need not necessarily be circulated back to the fluid container in operation of the vehicle but may be passed to another collection point (e.g. a wet sump for a lubricant) or may be consumed, for example as in the case of washer fluid.

As mentioned, the container 14 may comprise a filter 90 for filtering the fluid, for example when the fluid is an engine lubricating oil. Suitable filters 90 may comprise paper and/or metal filter elements. The filter 90 may be suitable for filtering particles in the range 1 to 100 microns, suitably in the range 2 to 50 microns, for example in the range 3 to 20 microns. The filter 90 may comprise a filter by-pass for fluid to bypass the filter, for example if the filter 90 becomes blocked or unacceptably loaded with material, which may cause an unacceptable or undesirable fluid back-pressure through the filter 90. An advantage of having a filter 90 in the container 14 is that this may allow a larger filter to be used than if the filter were in a separate container associated with the engine fluid circulation system 8. This may have one or more of the following benefits: (a) increased filtration efficiency; (b) finer filtration and (c) increased filter lifetime. Suitably, in use, fluid enters the container 14 through the inlet port 92 and is passed to the top of the container 14, for example through at least one conduit in the container 14; some or all of the fluid is passed through the filter 90 on exiting said conduit; and the totally or partially filtered fluid is withdrawn from the base of the container through the outlet port 91. The filter 90 may operate at elevated pressure. Many different types and grades of filter 90 are available, and in some examples the data provider may comprise an identifier of the filter.

As mentioned above, the data provider 1 may comprise a data store or memory storing an identifier of the fluid and/or the filter, and a communication interface to enable data stored in the memory of the data provider 1 to be passed via an appropriate wired or wireless communication link or network (such as the Internet or a WAN or LAN) to the processor 96 of the engine control device or a controller in one of the lifecycle stages or another controller, such as a controller (for example a server) associated with the supplier of the fluid container and/or its contents and/or associated with the supplier of a vehicle or vehicle make associated with the fluid container manufacturer, with or without the container being docked with a dock or a dedicated reception station. Any one or more communication paths may be encrypted with communication paths to different controllers generally using different encryption schemes.

The data provider 1 may comprise a computer readable identifier for identifying the fluid and/or the container, the identifier may be an electronic identifier, such as a near field RF communicator, for example a passive or active RFID (RadioFrequency Identification) tag, or an NFC (Near Field Communication) communicator.

The data provider 1 may be configured to be read only but, as in examples discussed above, may also be writable by an engine control device or any one of the controllers mentioned above via an appropriate wired or wireless communication link or network such as the Internet or a WAN or LAN.

The data provider 1 may provide simply an identifier identifying the actual data which may be accessible by the processor 96 or any one of the controllers mentioned above, from its own data store or from a remote data store accessible via a wired or wireless communication link or a network such as the Internet or a WAN or LAN. This enables accommodation for the possibility that the data associated with an identifier provided by a data provider may itself change with time even if the identifier does not, so enabling data regarding changes in any one or more of the container, fluid and or vehicle to be recorded in association with that identifier without the need for the data provider to be writable, for example data may be recorded by the engine control device and downloaded at service time to a computer data base accessible by the controllers of the lifecycle stages or may be provided directly from the engine control device and/or one or more of the controllers of the lifecycle stages to a central data base via a wireless and/or wired communication link or a network such as the Internet or a WAN or LAN.

The data associated with the data provider may comprise any appropriate data pertinent to at least one of the fluid, the container and the vehicle. In examples, the data associated with the data provider may comprise at least one property of the fluid selected from the group consisting of: the amount of fluid, the temperature of fluid, the pressure of fluid, the viscosity of fluid, the viscosity index of the fluid, the density of fluid, the electrical resistance of fluid, the dielectric constant of fluid, the opacity of fluid, the chemical composition of fluid, the origin of the fluid and combinations of two or more thereof. In some examples, the data associated with the data provider may comprise at least one property of the filter.

The data provider need not necessarily have a memory but may simply provide an identifier that enables access to associated data stored elsewhere. The identifier may be an optical identifier, such as a barcode, for example a two-dimensional barcode, or a colour coded marker, or optical identifier on the container or even the colour, shape and/or configuration of the container. Regardless of how it is provided, the identifier may be encrypted and any data communication may be encrypted.

The lifecycle stages other than the operational stages may share a controller or the functions of each controller may be distributed to two or more control devices. The controllers may be a processor or processors or other computer device with, where appropriate, a mechanical and/or electrical interface, to allow control of the filling and/or draining system.

Any described communication link may be a wired or wireless communication link or a combination thereof and could comprise an optical link. Where appropriate a communication link may be via a network such as the Internet or a WAN or LAN.

The fluid container has been described as comprising particular types of sensors. However, one or both of these sensors may be omitted. Where sensors are used any type of sensor, or combination of sensors can be used. For example, to sense the level of fluid in the container: a mechanical float, a position sensor, an electrical coil, capacitive sensors, resistivity sensors, ultrasonic level detection, visible or infra-red light detection, pressure sensing, or other sensors. The sensing system may provide information about the level in a continuous range between two fixed points or as discrete levels (e.g. full, half full, empty). Additionally, if the level of the liquid increased or decreased rapidly it could indicate some form of failure in the engine and provide an early warning mechanism to help prevent further damage to the engine. A fluid container may comprise sensors configured to sense at least one of a temperature, pressure, viscosity, density, electrical resistance, dielectric constant, opacity, chemical composition or amount of the container oil which data may be read and used by any of the processor or controllers described above. It will further be appreciated that a plurality of fluid sensors could be provided, each to sense a different property of the fluid.

Information about the fluid, e.g. oil, quality may be obtained through simple capacitance or resistivity measurements. These might, for example, indicate the presence of water in the oil or of metallic or carbonaceous particulates suspended in the oil. Optical measurement techniques may be used to assess, for example, clarity and/or colour of the fluid.

In the context of the present disclosure, those skilled in the art will appreciate that the fluid ports of the fluid container could comprise any suitable coupling for retaining the fluid container in fluid communication with the fluid circulation system. The port couplings could be arranged to be remotely decoupled from the fluid lines to place the fluid container in its uncoupled configuration. It will further be appreciated that the fluid container could comprise an actuator to decouple the fluid container from the circulation system or from any reception station.

As described above the data provider may be a read only or writable memory. The fluid container may however also carry a controller that may be part of or additional to the data provider. Such a controller may communicate (for example via a wired or wireless communication link and or via a network such as the Internet, a WAN or a LAN) with a vehicle control device or any of the other controllers mentioned above. Such a controller may enable, for example, on-container processing of data from a container sensor and/or data received from one or more of the controllers with which the fluid container controller may communicate and subsequent updating or modifying of any data stored by the data provider and/or communication with one or more other controllers of the results of that processing.

The dock may simply be the coupling to the fluid supply lines or a coupling plate or mount or may be a dedicated dock receptacle designed to receive at least a portion of the fluid container.

The function of the processors and controllers described above may be provided by any appropriate controller or control device, for example by analogue and/or digital logic, field programmable gate arrays, FPGA, application specific integrated circuits, ASIC, a digital signal processor, DSP, or by software loaded into a programmable general purpose processor. Aspects of the disclosure provide computer program products, and tangible and/or non-transitory media storing instructions to program a processor to perform any one or more of the methods described herein.

The container may be manufactured from metal and/or plastics material. Suitable materials include reinforced thermoplastics material which for example, may be suitable for operation at temperatures of up to 150° C. for extended periods of time.

The container may comprise at least one trade mark, logo, product information, advertising information, other distinguishing feature or combination thereof. The container may be printed and/or labelled with at least one trade mark, logo, product information, advertising information, other distinguishing feature or combination thereof. This may have an advantage of deterring counterfeiting. The container may be of a single colour or multi-coloured. The trademark, logo or other distinguishing feature may be of the same colour and/or material as the rest of the container or a different colour and/or material as the rest of the container. In some examples, the container may be provided with packaging, such as a box or a pallet. In some examples, the packaging may be provided for a plurality of containers, and in some examples a box and/or a pallet may be provided for a plurality of containers.

It may be possible to apply the present invention to fluid containers for use with engines other than in vehicles or for reverse engines or generators and turbines such as wind turbines. Suitable vehicles include motorcycles, earthmoving vehicles, mining vehicles, heavy duty vehicles and passenger cars. Powered water-borne vessels are also envisaged as vehicles, including yachts, motor boats (for example with an outboard motor), pleasure craft, jet-skis and fishing vessels. Also envisaged, therefore, are vehicles comprising a system of the present disclosure, or having been subject to a method of the present disclosure, in addition to methods of transportation comprising the step of driving such a vehicle and uses of such a vehicle for transportation.

Other variations and modifications will be apparent to persons of skill in the art in the context of the present disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A method of filling and draining a replaceable fluid container for an engine or vehicle, wherein the replaceable fluid container comprises a fluid reservoir and a plurality of container ports in fluidic communication with the fluid reservoir, wherein the replaceable fluid container is configured to be docked with a dock associated with the vehicle or engine with the plurality of container ports positioned on and coupled to at least one port of the dock to place the fluid reservoir in fluidic communication with a fluid circulation system associated with the vehicle or engine, wherein each of the plurality of container ports has an operational function during operation of the replaceable fluid container with the engine or vehicle, wherein the plurality of container ports includes a fluid outlet port having an operational function of supplying fluid from the fluid reservoir and a fluid inlet port having an operational function of supplying fluid to the fluid reservoir, the method comprising:

filling the fluid reservoir through the fluid inlet port while the replaceable fluid container is docked with the dock associated with the vehicle or engine;

removing the replaceable fluid container from the dock associated with the vehicle or engine;

coupling at least one of the plurality of container ports to a filling and/or draining element;

modifying the operational function of at least one of the plurality of container ports to assist draining of the fluid reservoir; and draining the fluid reservoir through at least one of the plurality of container ports using the filling and/or draining element.

2. The method of claim 1, wherein modifying the operational function of at least one of the plurality of container ports comprises modifying the operational function of at least one of the fluid inlet port or the fluid outlet port.

3. The method of claim 2, wherein modifying the operational function of at least one of the plurality of container ports comprises blocking the fluid inlet port.

4. The method of claim 2, comprising opening the fluid inlet port and maintaining it open during draining of the fluid container.

5. The method of claim 1, wherein the plurality of container ports includes a breather port having an operational function of allowing air to enter or exit the replaceable fluid container.

6. The method of claim 5, wherein modifying the operational function of at least one of the container ports comprises blocking the breather port during draining of the fluid reservoir.

7. The method of claim 1, wherein modifying the operational function of at least one of the container ports comprises opening the fluid inlet port and the fluid outlet port and draining the fluid reservoir through one of the fluid inlet port and the fluid outlet port whilst allowing air to enter or exit the replaceable fluid container through the other of the fluid inlet port and the fluid outlet port.

8. The method of claim 2, wherein modifying the operational function of at least one of the container ports comprises draining the fluid reservoir through both the fluid inlet port and the fluid outlet port.

9. The method of claim 8, comprising draining the fluid reservoir through both the fluid inlet port and the fluid outlet port simultaneously.

10. The method of claim 1, wherein modifying the operational function of at least one of the container ports comprises coupling a filling and/or draining interface plate between the replaceable fluid container and the filling and/or draining system of a replaceable fluid container management facility such that the interface plate couples at least one of the plurality of container ports of the replaceable fluid container to at least one of a plurality of draining elements of the filling and/or draining system.

11. A filling and/or draining interface plate configured to interface between a replaceable fluid container for a vehicle or engine and a filling and/or draining system of a replaceable fluid container management facility, wherein the replaceable fluid container comprises a fluid reservoir and a plurality of container ports in fluidic communication with the fluid reservoir, wherein the replaceable fluid container is configured to be docked with a dock associated with the vehicle or engine with the plurality of container ports positioned on and coupled to at least one port of the dock to place the fluid reservoir in fluidic communication with a fluid circulation system associated with the vehicle or engine, wherein each of the plurality of container ports has an operational function during operation of the replaceable fluid container with the engine or vehicle, the filling and/or draining interface plate comprising:

a first surface configured to cooperate with at least one of the plurality of container ports of the replaceable fluid container, a second surface configured to cooperate with at least one of a plurality of filling and/or draining elements of the filling and/or draining system, and at least one channel between the first surface and the second surface, the at least one channel being configured to fluidically couple at least one of the plurality of container ports to at least one of the plurality of filling and/or draining elements so as to modify an operational function of at least one of the plurality of container ports.

12. The filling and/or draining interface plate of claim 11, wherein the at least one channel is configured to modify the operational function of at least one of a fluid outlet port and a fluid inlet port of the plurality of container ports of the replaceable fluid container.

13. The filling and/or draining interface plate of claim 12, wherein modifying the operational function of at least one of the plurality of container ports comprises blocking the fluid inlet port.

14. The filling and/or draining interface plate of claim 12, wherein modifying the operational function of at least one of the plurality of container ports comprises opening the fluid inlet port and maintaining it open during filling and/or draining of the fluid container.

15. The filling and/or draining interface plate of claim 12, wherein the plurality of container ports includes a breather port arranged to allow air to enter or exit the replaceable fluid container.

16. The filling and/or draining interface plate of claim 15, wherein the filling and/or draining interface plate is configured to block or inhibit opening of the breather port during filling and/or draining of the fluid reservoir to avoid contamination of the breather port with the fluid.

17. The filling and/or draining interface plate of claim 16, wherein the interface plate is configured to inhibit opening of a valve of the breather port.

18. The filling and/or draining interface plate of claim 12, wherein the filling and/or draining interface plate is configured to couple one of the fluid inlet port and the fluid outlet port to a filling and/or draining element via the at least one channel to allow filling and/or draining the fluid reservoir through that port, and couple the other of the fluid inlet port and the fluid outlet port to air to allow air to enter or exit the replaceable fluid container through that port.

19. The filling and/or draining interface plate of claim 12, wherein the filling and/or draining interface plate is configured to open a valve of one of the fluid inlet port and the fluid outlet port and to couple that port to a filling and/or draining element via the at least one channel to allow filling and/or draining the fluid reservoir through that port and to open a valve of the other of the fluid inlet port and the fluid outlet port to air to allow air to enter or exit the replaceable fluid container through that port.

20. The filling and/or draining interface plate of claim 12, wherein the filling and/or draining interface plate is configured to couple the fluid inlet port and the fluid outlet port to at least one filling and/or draining element via the at least one channel to allow filling and/or draining of the fluid reservoir through both the fluid inlet port and the fluid outlet port.

21. The filling and/or draining interface plate of claim 12, wherein the filling and/or draining interface plate is configured to open a valve of each of the fluid inlet port and the fluid outlet port and to couple the fluid inlet port and the fluid outlet port to at least one filling and/or draining element via the at least one channel to allow filling and/or draining of the fluid reservoir through both the fluid inlet port and the fluid outlet port.

22. The filling and/or draining interface plate of claim 20, wherein the filling and/or draining interface plate is configured to couple the fluid inlet port and the fluid outlet port to a single filling and/or draining element via the at least one channel.

23. The filling and/or draining interface plate of claim 20, wherein the filling and/or draining interface plate has a plurality of channels and is configured to couple the fluid inlet port and the fluid outlet port to different filling and/or draining elements via respective ones of the plurality of channels.

24. A kit comprising a filling and/or draining interface plate according to claim 11 and a replaceable fluid container for a vehicle or engine, wherein the replaceable fluid container comprises a fluid reservoir and a plurality of container ports, wherein the replaceable fluid container is configured to be docked with a dock associated with the vehicle or engine with the plurality of container ports positioned on and coupled to at least one port of the dock to place the fluid reservoir in fluidic communication with a fluid circulation system associated with the vehicle or engine.

25. A method of draining a replaceable fluid container for an engine or vehicle that is filled with a fluid, wherein the replaceable fluid container comprises a fluid reservoir and a plurality of container ports in fluidic communication with the fluid reservoir, wherein the replaceable fluid container is configured to be docked with a dock associated with the vehicle or engine with the plurality of container ports positioned on and coupled to at least one port of the dock to place the fluid reservoir in fluidic communication with a fluid circulation system associated with the vehicle or engine, wherein each of the plurality of container ports has an operational function during operation of the replaceable fluid container with the engine or vehicle, wherein the plurality of container ports includes a fluid outlet port having an operational function of supplying fluid from the fluid reservoir and a fluid inlet port having an operational function of supplying fluid to the fluid reservoir, wherein the fluid reservoir is filled through the fluid inlet port while the replaceable fluid container is docked with the dock associated with the vehicle or engine, and wherein the fluid container is removed from the dock associated with the vehicle or engine, the method comprising:

coupling at least one of the plurality of container ports to a filling and/or draining element;

modifying the operational function of at least one of the plurality of container ports to assist draining of the fluid reservoir; and draining the fluid reservoir through at least one of the plurality of container ports using the filling and/or draining element.

* * * * *